US005667419A

United States Patent [19]

Spector

[11] Patent Number: 5,667,419

[45] Date of Patent: *Sep. 16, 1997

[54] WATER-PISTOL AND ANIMAL FIGURE ASSEMBLY

[76] Inventor: Donald Spector, 380 Mountain Rd., Union City, N.J. 07087

[ * ] Notice: The term of this patent shall not extend beyond the expiration date of Pat. No. 5,564,961.

[21] Appl. No.: 607,114

[22] Filed: Feb. 26, 1996

Related U.S. Application Data

[63] Continuation-in-part of Ser. No. 554,259, Nov. 6, 1995, Pat. No. 5,605,485, which is a continuation-in-part of Ser. No. 431,834, May 1, 1995, Pat. No. 5,564,961.

[51] Int. Cl.[6] ..... A63H 3/00; A63H 33/30; A63H 3/18; B05B 1/00

[52] U.S. Cl. ..... 446/72; 446/74; 446/473; 446/475; 222/78; 222/79; 239/211

[58] Field of Search ..... 446/72, 74, 472, 446/475, 267, 268, 327, 369; 222/78, 79; 239/211

[56] References Cited

U.S. PATENT DOCUMENTS

| | | | |
|---|---|---|---|
| 1,767,911 | 6/1930 | Berko et al. | 446/72 X |
| 3,299,891 | 1/1967 | Smeton | 446/74 X |
| 5,071,387 | 12/1991 | Pottick | 446/74 X |
| 5,150,819 | 9/1992 | Johnson et al. | 222/79 |
| 5,319,202 | 6/1994 | D'Andrade | 446/473 X |
| 5,366,108 | 11/1994 | Darling | 446/473 X |

FOREIGN PATENT DOCUMENTS

| | | | |
|---|---|---|---|
| 92/21446 | 12/1992 | WIPO | 446/475 |
| 94/00208 | 1/1994 | WIPO | 446/473 |

*Primary Examiner*—Mickey Yu
*Assistant Examiner*—D. Neal Muir
*Attorney, Agent, or Firm*—Michael Ebert

[57] ABSTRACT

A water-pistol and animal figure assembly in which a pistol whose operating mechanism is concealed in the figure causes water to spit out of the mouth of the figure when the pistol is operated. The pistol includes a stock from which depends a hand grip provided with a trigger, a water reservoir in the form of a cylindrical tank mounted above the stock and an internal pump which draws water from the tank and pumps it into the barrel of the pistol from whose nozzle the water is ejected when the trigger is pulled. The animal figure includes a head having an open mouth and a body having an internal cavity which communicates with the head, and is open at its rear end. The pistol is received within the cavity with its barrel socketed in the head of the figure and its nozzle aligned with the open mouth, the water tank being exposed outside of the body. A player who inserts his hand through the open end of the body and grasps the grip of the pistol then appears to be holding the figure, and when he pulls the trigger, water is ejected from the mouth of the figure who then appears to be spitting. When the supply of water is exhausted it may be replenished by feeding water into the exposed water tank which is provided with a removable stopper.

9 Claims, 2 Drawing Sheets

WATER-PISTOL AND ANIMAL FIGURE ASSEMBLY

RELATED APPLICATIONS

This application is a continuation-in-part of my application of the same title Ser. No. 08/554,259 filed Nov. 11, 1995 now U.S. Pat. No. 5,605,485 entitled "WATER-PISTOL AND PUPPET ASSEMBLY" which is a continuation in part of my application Ser. No. 08/431,834, filed May 1, 1995 now U.S. Pat. No. 5,564,961, entitled "WATER-PISTOL AND PUPPET ASSEMBLY" whose entire disclosures are incorporated herein by reference.

BACKGROUND OF INVENTION

1. Field of Invention

This invention relates generally to water-pistols and more particularly to a water-pistol and animal figure assembly which when a player grasps the grip of the pistol housed within the figure, he then appears to be holding the figure, and when he operates the pistol to eject water therefrom, the animal then appears to be spitting out this water.

2. Status of Prior Art

Children enjoy playing with stuffed animal figures, for these soft figures which resemble familiar animals, such as lions and tigers, have a plush covering and can be squeezed, hugged and otherwise manipulated in play. A long-time favorite is the classic Teddy Bear.

Thus the Stone U.S. Pat. 5,059,149 discloses a stuffed Teddy Bear provided with a storage compartment for housing books and other articles. Stuffed animal figures representing various animals are available in most toy stores, making it possible for a child to choose his favorite animal as a pet.

A water-pistol is also a highly popular toy, for children take delight in spraying other children with water. All water pistols regardless of their internal mechanism, include a hand grip provided with a trigger which when pulled by the player grasping the grip, then draws liquid from a liquid reservoir housed in the pistol and pumps the liquid into a barrel from whose outlet nozzle the liquid is ejected. Of prior art background interest is the U.S. Pat. No. 3,678,789 to Ferri showing a water pistol having a trigger-actuated pump for withdrawing liquid from a reservoir and supplying it to the nozzle of the gun.

Most toys which children enjoy seek to emulate adult activity. Thus a child playing with a toy automobile prefers that this toy vehicle closely resemble a model of a Cadillac or other well-known auto, rather than being purely fanciful.

In recent years, the trend in water-pistol design has been toward creating realistic replicas of military or police small arms. This makes it possible for children playing with these water-pistols to imitate a cops and robbers gun fight or actual military combat.

But water-pistols which resemble real weapons are now in public disfavor, and in some states they are banned by law. The reason for the interdiction of water-pistols which are replicas of real weapons is that crime is now rampant in the streets of most American cities and even in many suburbs. Police under stress may be unable to distinguish between a real gun and a water-pistol that is a replica of this gun. As a consequence of this confusion, there are instances where a police officer has shot a child pointing a water-pistol at him, thinking it was a real gun.

Yet water-pistols are essentially innocuous and it is unfair to deprive children of the joys of playing with these toys. On the other hand, an exposed water-pistol is no longer acceptable to the public.

In my above-identified copending application of the same title there is disclosed a pistol and stuffed animal figure assembly in which the pistol is concealed within the figure, yet is fully operable. The pistol includes a hand grip provided with a trigger, a liquid reservoir in the form of a cartridge clip insertable in the grip and a pump which when the trigger is pulled then draws liquid from the reservoir and pumps it into the barrel of the pistol from whose outlet nozzle the liquid is ejected. The figure includes a head having an open mouth that simulates that of an animal, and a body having an internal cavity that is open at its end and communicates with the head.

The pistol is received within the body cavity with its barrel socketed in the head of the figure so that the outlet nozzle is in alignment with the open mouth. When a player extends his hand into the cavity to grasp the grip of the pistol, he then appears to be holding the figure. And when the player pulls the trigger to cause liquid to be ejected from the outlet nozzle, the figure then appears to be spitting out this liquid.

The advantage of this prior assembly is that the operating water-pistol is disguised as an animal figure so that one who sees the figure has no idea of its true function, yet the child who plays with the concealed pistol can shoot water therefrom.

Another advantage of this prior assembly is that the water-pistol which may be a replica of a real weapon having a removable cartridge clip is fully concealed by the figure and therefore cannot be mistaken for a real weapon. And it may be reloaded with water without removing the pistol from the figure, for the cartridge functions as a water reservoir and to reload the pistol the empty cartridge is removed and the water is replenished.

The typical water pistol has an internal water reservoir placed above the grip in line with the barrel of the gun, the reservoir being provided with a removable stopper so that the water can be replenished. When therefore a pistol of this type is concealed in a figure and the water in the pistol reservoir is exhausted, one had to withdraw the pistol from the figure in order to replenish the water, after which the water-loaded pistol is returned to the figure. This reloading procedure is somewhat difficult for many children to carry out, and is at the very least inconvenient. The advantage of using a water pistol is which the removable cartridge clip functions as a water reservoir is that one can reload this pistol with water without having to remove the entire water pistol from the figure, only the cartridge being removed.

However, a cartridge clip serving as a water reservoir has a limited water capacity which is exhausted after a relatively brief period of water pistol use. When a child is engaged in water combat game with another child, which he wins by striking the other child with water before the other child succeeds in striking him, it is frustrating for the players to have the supply of water exhausted in the course of play, for this brings the game to a premature halt.

SUMMARY OF INVENTION

In view of the foregoing, the main object of this invention is to provide a water-pistol and figure assembly in which the operating mechanism of the pistol is concealed in the figure, but not its water reservoir.

A significant feature of the invention is that the water reservoir of the water pistol is not an internal reservoir or a removable cartridge clip reservoir, but takes the form of a transparent cylindrical tank mounted above the stock of the pistol and parallel thereto, the tank having a relatively large water capacity to permit prolonged play with the assembly.

More particularly an object of this invention is to provide an assembly of the above type in which the cylindrical tank serving as the water reservoir of the water-pistol is exposed on the outside of the body of the figure within which the operating mechanism of the pistol is concealed.

But while an observer of the assembly can see the water tank, as well as the figure, what he sees does not reveal the fact that the water tank is associated with a water-pistol.

Briefly stated, these objects are attained by a water-pistol and animal figure assembly in which a pistol whose operating mechanism is concealed in the figure causes water to spit out of the mouth of the figure when the pistol is operated. The pistol includes a stock from which depends a hand grip provided with a trigger, a water reservoir in the form of a cylindrical tank mounted above the stock and an internal pump which draws water from the tank and pumps it into the barrel of the pistol from whose nozzle the water is ejected when the trigger is pulled.

The animal figure includes a head having an open mouth and a body having an internal cavity which communicates with the head and open at its end. The pistol is received within the cavity with its barrel socketed in the head of the figure and its nozzle aligned with the open mouth, the water tank being exposed outside of the body. A player who inserts his hand through the open end of the body and grasps the grip then appears to be holding the figure, and when he pulls the trigger, water is ejected from the mouth of the figure who then appears to be spitting. When the supply of water is exhausted it may be replenished by feeding water into the exposed water tank which is provided with a removable stopper.

BRIEF DESCRIPTION OF DRAWINGS

For a better understanding of the invention, as well as further features thereof, reference is made to the detailed description thereof to be read in connection with the annexed drawings wherein.

DESCRIPTION OF INVENTION

Figure 1:
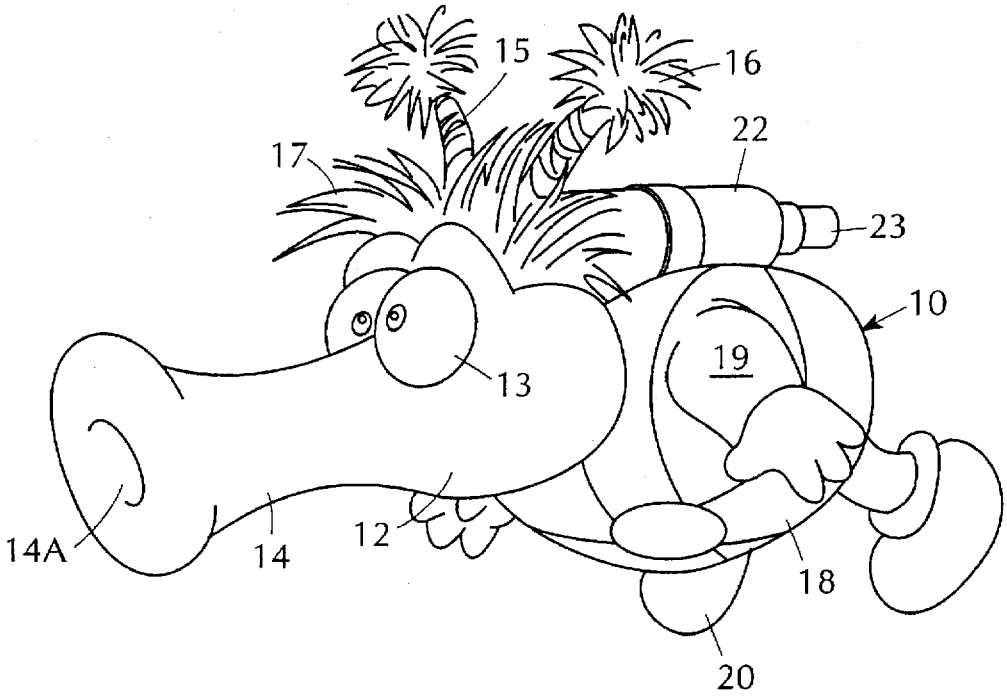
FIG. 1 is a perspective view of a water-pistol and animal figure assembly in accordance with the invention.
Figure 2:
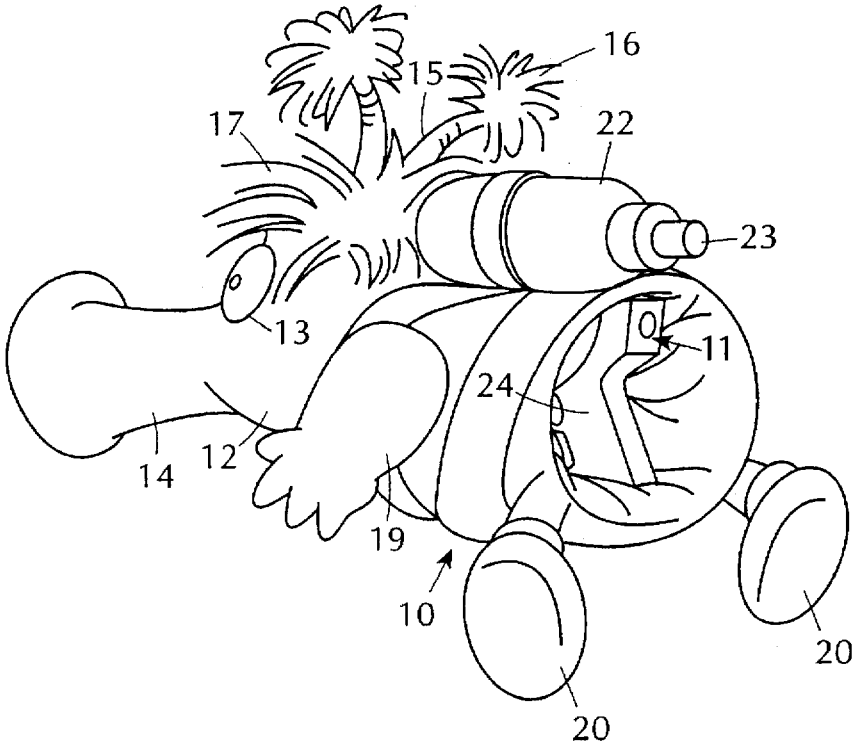
FIG. 2 is a rear view of the animal figure showing the water-pistol concealed within the figure.
Figure 3:
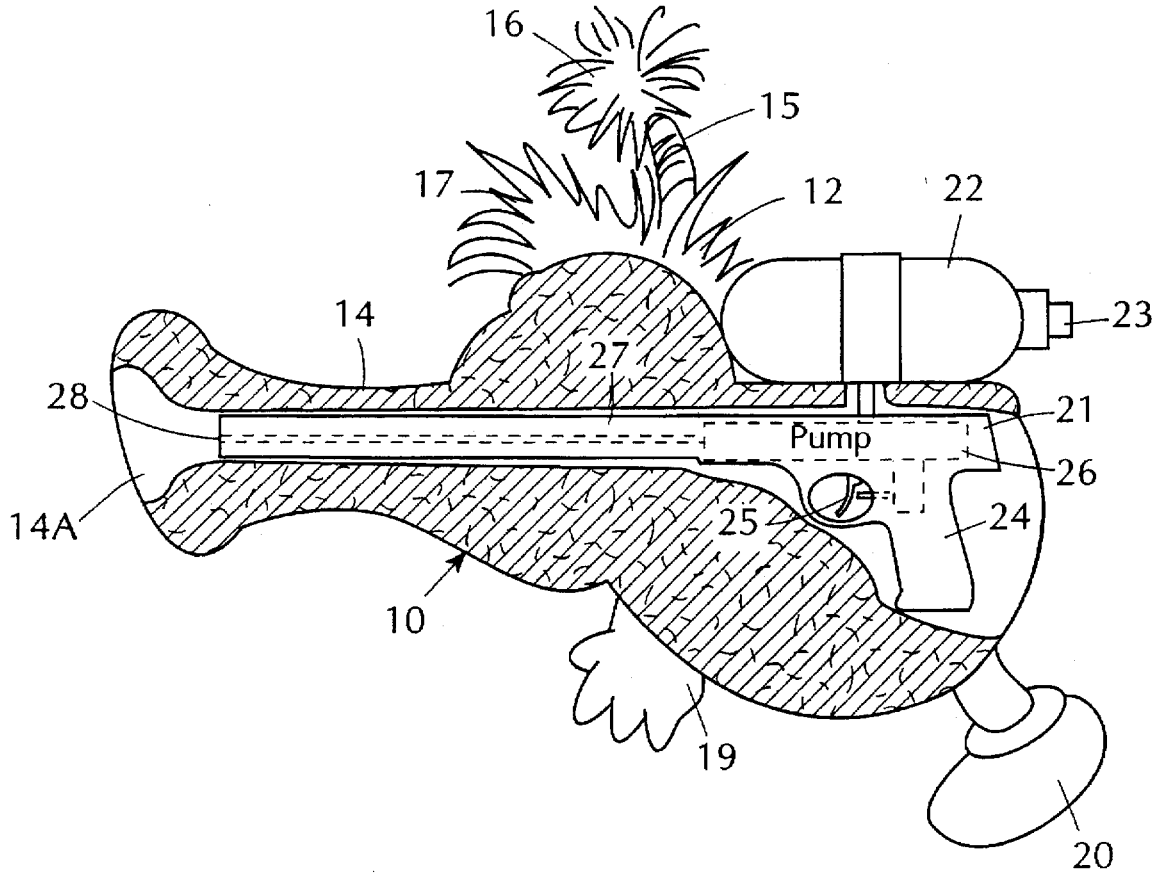
FIG. 3 is a cut-away view showing how the water-pistol is supported within the body of the figure.

FIGS. 1 to 3 illustrate a water-pistol and stuffed animal figures assembly in accordance with one preferred embodiment of the invention. The figure is generally designated by reference numeral 10 and the water-pistol by reference numeral 11.

Animal FIG. 10 is entirely fanciful and may exist in mythology, not reality. FIG. 10 includes a head 12 having a pair of eyes 13 and an elongated, hollow trunk 14 which projects forwardly from the head and simulates what in effect is a combined open mouth and nose having an outlet 14A. In place of ears, the head is provided with miniature trees 15 and 16 emerging from a cluster of grass 17 simulating hair on head 12. FIG. 10 is provided with a hollow body 18 which extends from head 12 and is open at its rear end. Body 18 is provided with arm and foot appendages 19 and 20.

Water-pistol 11, as best seen in FIG. 3, is provided with a rear stock 21 above which is mounted a transparent cylindrical plastic tank 22 having a removable stopper 23. Tank 22 which serves as a water reservoir is parallel to the stock.

Depending from stock 21 is a hand grip 24 provided with a trigger 25 which when pulled by a finger of a hand grasping grip 24 pushes in a spring-loaded piston rod which then actuates a water pump 26 to draw water from tank 22. The water is pumped into the barrel 27 of the pistol and is discharged from a nozzle 28 at the front end of the barrel which is aligned with outlet 14A of the animal trunk.

What comes out of nozzle 28 is not a continuous stream of water, but a squirt or pulse of water, for each time trigger 25 is pulled, the piston rod is pushed in to actuate pump 26 and thereby produce a squirt of water, the rod returning to its normal pushed-out position when the trigger is released.

The pistol is placed within the hollow body 19 of the figure so that its barrel 27 is socketed within the head 12 of the figure and extends into and is coaxial with the tubular mouth-like trunk 14 projecting from the head, nozzle 28 at the end of barrel 27 being in line with the outled 14A of the trunk. The grip 24 of the pistol is adjacent the open rear end of the body, as best seen in FIG. 2, and is therefore accessible to the hand of a player.

When therefore a player inserts his hand into the open rear end of the body of the figure and grasps grip 24 of the pistol 11, he then appears to be holding the figure in his hand, not a pistol. But when the player holding the figure pulls the pistol trigger, water spits out of the mouth/trunk 14 as if the figure were spitting.

The advantage of this water-pistol and animal figure assembly is that one can replenish the water in reservoir tank 22 without having to remove the pistol from the animal figure to do so. Since tank 22 is transparent, one sees the extent to which it has been emptied and when it is necessary to refill it. To do so, one has only to pull out stopper 23, fill the tank 22 with water, and return the stopper to the tank. This is a very easy procedure even though the tank is mounted on the outer surface of the body of the figure.

A player holding the figure can point the projecting trunk 14 thereof in any direction, this being the line of fire, for when the pistol is actuated, water will spit out of the trunk.

FIG. 10 shown in the drawing is but one example of a fanciful figure, and in practice it preferably has a plush, soft construction so that it is pleasant to hold or hug. And the figure need not be animal-like in form for it may be a humanoid figure or a replica of a cartoon character, such as Popeye.

While there has been shown and described a preferred embodiment of a water-pistol and animal figure assembly, it will be appreciated that many changes and modifications may be made therein without, however, departing from the essential spirit of the invention. Thus instead of the internal cavity in the body of the figure having an opening at the rear of the body, the opening may be placed at the belly of the body, the grip of the pistol being aligned with the belly opening. Hence to grasp this grip, the player inserts his hand through the belly opening.

I claim:

1. A water-pistol and figure assembly comprising:

A. a figure having a head provided with an open mouth, a body joined to the head having an internal cavity communicating with the head and with an access opening in the body; and B. a water pistol having a working mechanism concealed in the cavity of the figure, said pistol having a barrel that is socketed in the head and is provided with a nozzle in alignment with the open mouth, said pistol having a hand grip provided with a trigger which when the grip is grasped by a player's hand extended into the cavity through the access opening in the body, the figure then appears to be held by the player, and when the player pulls the trigger with a finger of his hand, water is then ejected from the nozzle and spit out of the open mouth of the figure, said pistol being provided with a water reservoir which is on the outside of the body of the figure and a pump which when the trigger is pulled, then draws water from the reservoir and pumps it into the barrel.

2. An assembly as set forth in claim 1, in which the access opening is at the rear of the body.

3. An assembly as set forth in claim 1, in which the water reservoir is a cylindrical tank having a removable stopper.

4. An assembly as set forth in claim 3, in which the tank is formed of transparent plastic material.

5. An assembly as set forth in claim 1, in which the figure is that of a four legged animal and said body is provided with arm and leg appendages.

6. An assembly as set forth in claim 5, in which the animal figure is a stuffed, soft, plush figure.

7. An assembly as set forth in claim 1, in which the pump is provided with a spring-biased piston rod that is engaged by the trigger, so that each time the trigger is pulled, the piston rod is pushed in to actuate the pump to produce a squirt of water.

8. An assembly as set forth in claim 1, in which the head of the figure is provided with an elongated, projecting, hollow trunk whose outlet constitutes said open mouth.

9. An assembly as set forth in claim 8, in which the barrel of the pistol is coaxial with said hollow trunk.

* * * * *